United States Patent [19]

Judson, Jr.

[11] 4,143,823

[45] Mar. 13, 1979

[54] HAMMERMILLS

[76] Inventor: Carl Judson, Jr., Rte. 2, Livermore, Colo. 80536

[21] Appl. No.: 830,882

[22] Filed: Sep. 6, 1977

[51] Int. Cl.[2] ..... B02C 13/06

[52] U.S. Cl. ..... 241/73; 241/100; 241/101.7; 241/189 R; 241/191

[58] Field of Search ..... 241/73, 99, 100, 101.7, 241/189 R, 189 A, 191

[56] References Cited

U.S. PATENT DOCUMENTS

| | | | |
|---|---|---|---|
| 1,840,749 | 1/1932 | Stresau | 241/191 |
| 3,412,770 | 11/1968 | Johnson | 241/101.7 X |
| 3,625,138 | 12/1971 | Shinn et al. | 241/73 X |
| 3,655,138 | 4/1972 | Luscombe | 241/99 |
| 3,756,520 | 9/1973 | Hughes | 241/100 X |
| 3,825,192 | 7/1974 | Knight | 241/189 R X |
| 3,913,849 | 10/1975 | Atanasoff et al. | 241/99 X |

FOREIGN PATENT DOCUMENTS

| | | | |
|---|---|---|---|
| 155479 | 1/1952 | Australia | 241/73 |

*Primary Examiner*—Howard N. Goldberg
*Attorney, Agent, or Firm*—Hugh H. Drake

[57] ABSTRACT

In an upper portion of a housing is a material-receiving chamber below which is a lower portion that defines a comminution chamber. An apertured screen is disposed in the bottom of the latter for permitting the gravity discharge of material which has been comminuted. Mounted horizontally within the lower portion is a shaft, and that shaft is driven in rotation. A plurality of hammers project rigidly outward from the shaft with the hammers being arranged in an assembly which includes a plurality of hammer-carrying elements individually spaced successively along the shaft. The hammers on each element are circumferentially spaced successively around the shaft. Moreover, each hammer includes a material-impacting face of concave arcuate conformation in the plane of movement of the hammers.

9 Claims, 9 Drawing Figures

HAMMERMILLS

The present invention pertains to hammermills. More particularly, it relates to a kind of hammermill in which simplicity permits production on a basis making the hammermill available to small-business users.

In itself, the hammermill is a well-known apparatus for comminuting material. As contrasted with extruding, grinding or crushing, the basic nature of a hammermill is that of employing hammering elements which literally pound particles into pieces. Following that basic approach, numerous prior art apparatus are known for pulverizing material. As the art has progressed, considerable attention has been devoted to increasing the swing rate of the hammers so as to deliver a greater impacting force to the material for a given size and speed of machine operation. Indeed, quite successful machines have been developed for handling the milling of huge quantities of rock or the like wherein reduction to sand or powder is desired on a high-volume basis. Unfortunately, this progress in the art has left unsatisfied a need for a completely workable but yet simple and economical hammermill of a kind which might be useful, for example, to the individual potter desiring to prepare his own clay, glaze materials or grog.

It is, accordingly, a general object of the present invention to provide a new and improved hammermill which achieves the desired result in a more expedient manner.

Another object of the present invention is to provide a new and improved hammermill which features simplicity of construction and yet accomplishes a worthwhile result.

A hammermill as constructed in accordance with the present invention includes an upright housing that has an upper portion which defines a material-receiving chamber and a lower portion which defines a comminution chamber. An apertured screen is disposed in the bottom of the comminution chamber for permitting the gravity discharge of material comminuted within the lower portion. Disposed in that lower portion is means for comminuting the material deposited into the upper portion. That takes the form of a shaft mounted horizontally within the lower portion together with means for driving that shaft in rotation. A plurality of hammers project rigidly outward from the shaft with those hammers being arranged in an assembly which includes a succession of hammer-carrying elements individually spaced successively along the shaft. Each of the elements has a plurality of the hammers circumferentially spaced successively around the shaft. Finally, each of the hammers includes a material-impacting face of concave arcuate conformation in the plane of movement of the hammers.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
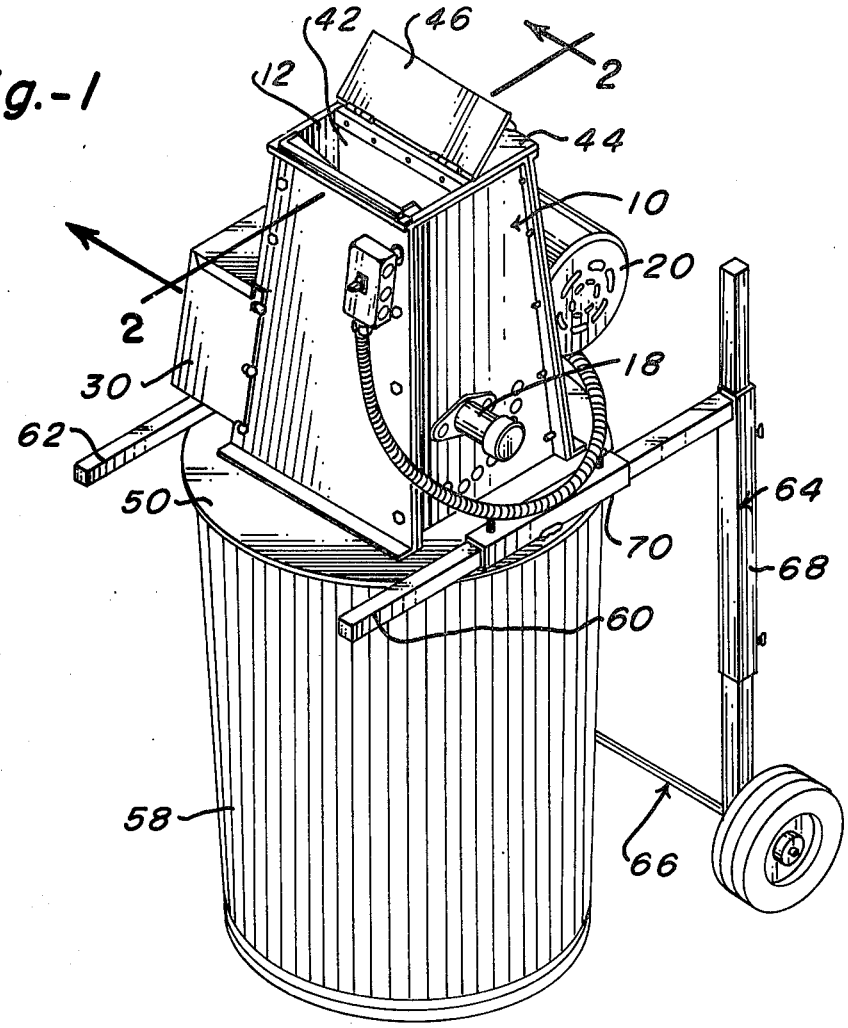
FIG. 1 is a perspective view of one embodiment of the present invention.
Figure 2:
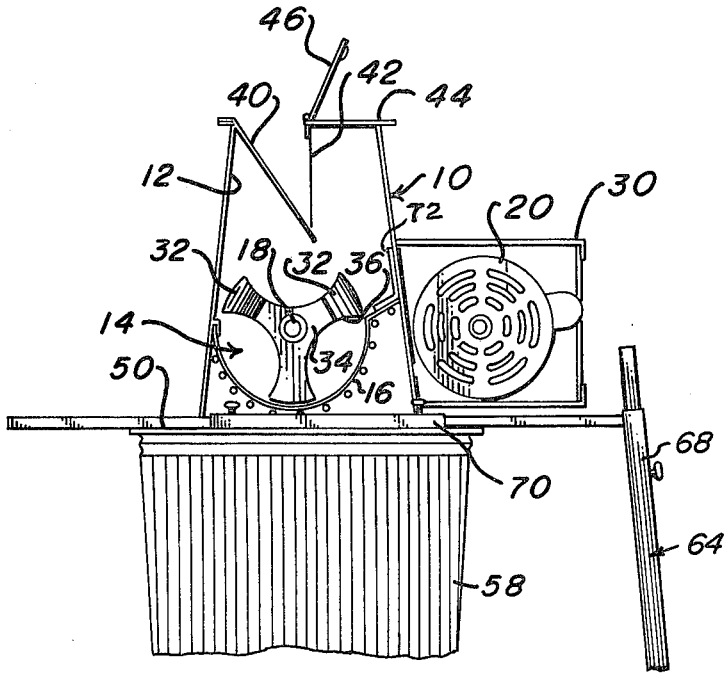
FIG. 2 is a fragmentary cross-sectional view taken along the line 2—2 in FIG. 1.
Figure 3:
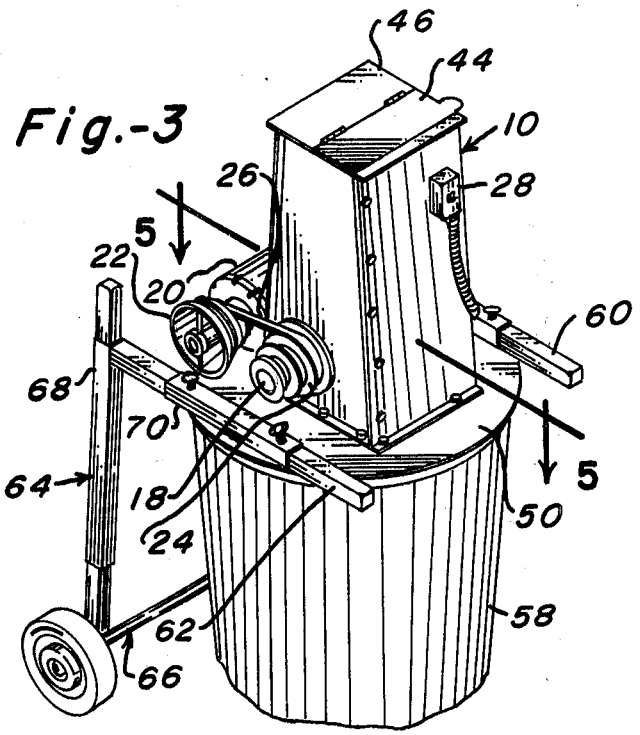
FIG. 3 is another perspective view, taken from a different direction than that of FIG. 1, fragmented and with certain parts in a different position or removed.
Figure 5:
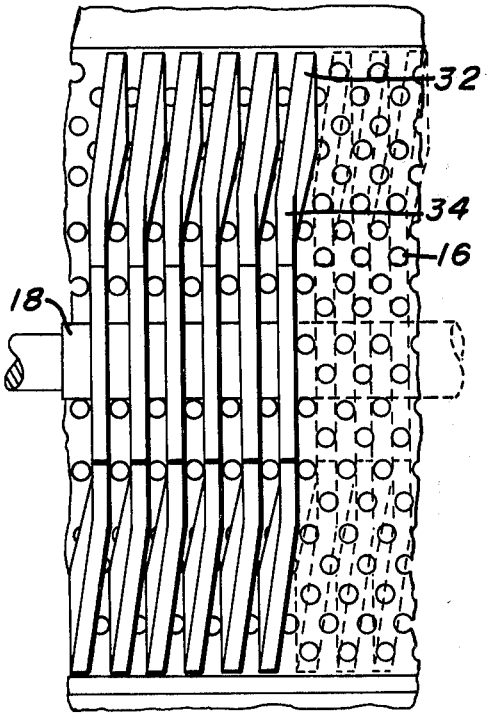
FIG. 5 is a fragmentary cross-sectional view taken along the line 5—5 in FIG. 3.
Figure 4:
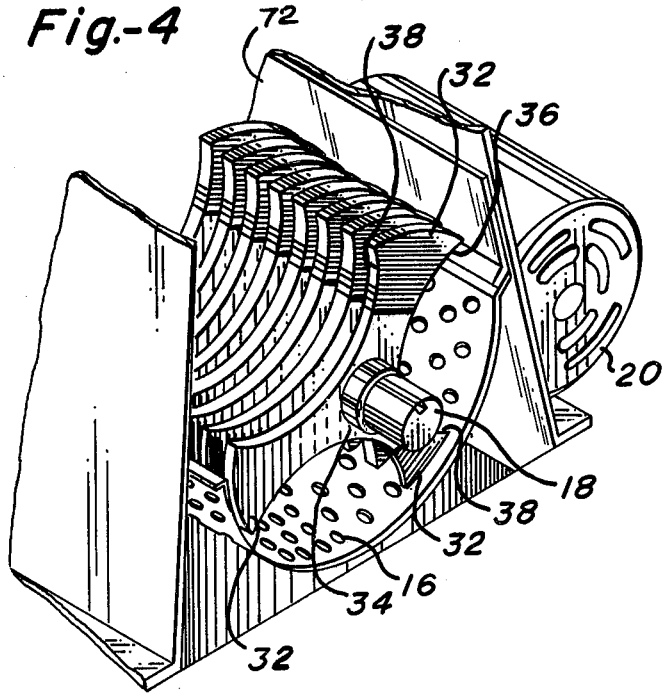
FIG. 4 is a fragmentary perspective view of a portion of the apparatus shown in FIG. 1.
Figure 9:
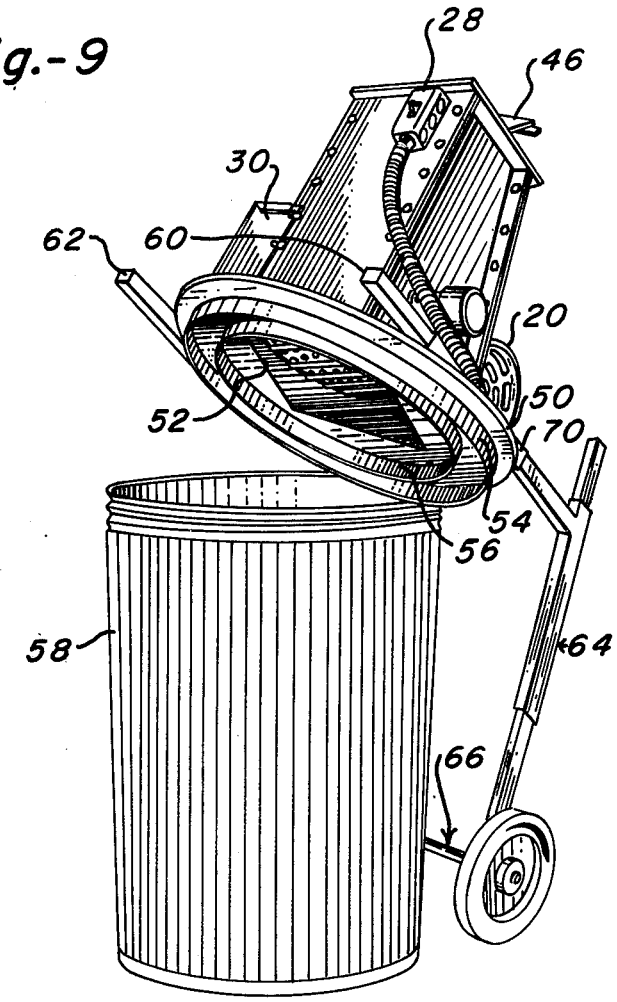
FIG. 9 is a perspective view of the combination shown in FIG. 1 but with a different orientation of components.
Figure 6:
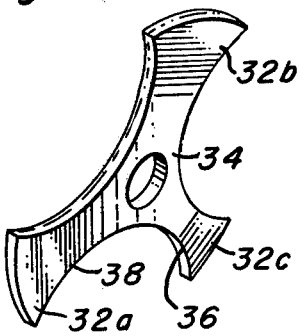
FIG. 6 is a perspective view of a component shown in FIGS. 2, 4 and 5.
Figure 7:
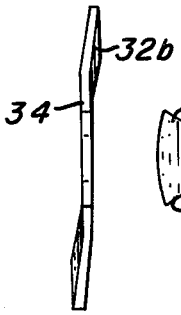
FIG. 7 is a side elevational view of that same component.
Figure 8:
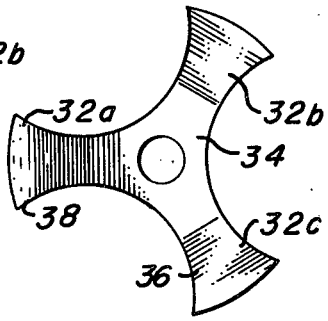
FIG. 8 is a front elevational view also of the same component.

As illustrated for the purpose of depicting a preferred embodiment, an upright housing 10 includes an upper portion which defines a material-receiving chamber 12 and a lower portion which defines a comminution chamber 14. An apertured screen 16 is disposed in the bottom of chamber 14 so as to permit the gravity discharge of material that has been comminuted by the apparatus to be described. A shaft 18 is journalled between opposing side walls of housing 10 in its lower portion 14 so as to be rotatable. An electric motor 20 is coupled, by means of pulleys 22 and 24 together with a drive belt 26, to drive shaft 18 in rotation. Preferably, pulleys 22 and 24 are of the multiple-step type so as to permit adjustment of the speed of rotation of shaft 18 relative to that of motor 20 merely by changing the pulley steps upon which belt 26 is mounted. A switch 28, mounted upon a side wall of housing 10, serves to permit the operator to stop and start functioning of the unit. Preferably, pulleys 22 and 24 as well as belt 26 are enclosed within a shield 30 as shown in FIGS. 1 and 2.

A plurality of hammers 32 project rigidly outward from shaft 18. Hammers 32 are arranged in an assembly which includes a plurality of hammer-carrying elements 34 individually spaced successively along shaft 18 and with each of those elements having a plurality of three of hammers 32 circumferentially spaced successively around shaft 18. Each of hammers 32 includes a material-impacting face 36 of concave arcuate conformation in the plane of movement of hammers 32. Moreover, each of faces 36 merges into a reversely-directed concave face 38 of the next successive one of the hammers. As a result, either faces 36 or faces 38 may in operation become the impacting faces. Assuming the installation of shaft 18 in a first given orientation, faces 36 may be assumed to be those which do the actual impacting of the material to be comminuted. When those faces 36 become unduly worn, it is only necessary to reverse the orientation of shaft 18 and thereby present a new set of faces 38 for performing the hammering function.

Each of the three different ones of hammers 32 projecting from each one of elements 34 is differently displaced in a direction relative to shaft 18. On each element 34, one hammer **32*a* lies in a common plane with element 34. A second element 32*b* is bent in one direction along the axis of shaft 18. The third element 32*c* is bent in the opposite direction relative to that axis. The totality of the hammers projecting from each element 34, therefore, serve rather thoroughly to occupy the space between that one of elements 34** and the next.

Included within upper portion 12 is a baffle 40 that serves to direct received material into the concavities defined on the rotary assembly by the shape of hammers 32. In itself, that application of the material tends to confine the same into lower portion 14. In addition, the possibility of a piece of material being deflected upwardly out of the unit is further precluded by the interpositioning of a resilient flap 42 downwardly depending from the top wall 44 of housing 10. Furthermore, housing 44 includes a hinged lid 46 closable over the opening above baffle 40.

As shown, housing 10 projects uprightly from a baseplate 50. A central opening 52 in baseplate 50 is located beneath screen 16. Downwardly depending from the underside of baseplate 50 are a pair of concentric rings 54 and 56. Rings 54 and 56 are of respective diameters so that one or the other, or both, accommodate the upper rims of differently sized receptacles such as ordinary trash cans. Accordingly, a trash can 58 is indicated in different ones of the figures as constituting a receptacle upon which the overall apparatus is mounted. To the end of facilitating accommodation to such a can, baseplate 50 preferably is secured to a pair of spaced-opposed arms 60 and 62 which, in turn, extend from uprights 64 of a wheeled-dolly 66. Adjustable sleeves 68 and 70 on dolly 66 permit further adjustment of the overall positioning of housing 10 relative to any given height or diameter of receptacle 58. The use of the one of rings 54 and 56 which most closely mates with the upper rim of container 58, together with adjustment of sleeves 68 and 70, permit the rather tight securement of baseplate 50 on top of container 58. Preferably, uprights 64 slant downwardly and outwardly a slight amount to insure stability while the weight of the unit urges the bottom of plate 50 against the rim of the receptacle. This is advantageous in reducing the leakage of the material dust which invariably is produced in such a comminution technique.

In operation, the material to be ground or comminuted is placed into the hopper effectively closable by lid 46. That material is deflected by baffle 40 so as to fall within the radially-central portion of the rotary assembly. In that portion of the assembly, the material is "hammered" so as to break it into the smaller particles that will pass through screen 16. Of course, the comminuted material passes through screen 16 and on downwardly, by gravity, into container 58. The arcuate shape of the impact portions of the hammers insures a thorough "pounding" of the material to be comminuted. That is, the arcuate shape of the hammer faces tends to hold the bulk material within the rotating assembly, while the faces tend to impact the material more squarely than if they were radial to shaft 18. The relationship of the blades to the entry portion of the housing, including baffle 40, facilitates delivery of the material to the hammers in a manner to achieve maximum comminuting action while yet guarding against the flying back of a stone or other particle which had been inserted. Being adapted to utilize ordinary trash cans or the like for receipt of the comminuted material, the overall apparatus achieves an additional degree of economy.

Preferably, screen 16 is removably secured in place by fasteners such as cotter pins. This permits both replacement and the substitution of screens with different mesh sizes. Typical screen openings vary between one-eighth and one-half inch, although smaller openings may be used to yield finer particles. The combination of rotor speed adjustment and different screen sizes affords substantial flexibility in material handling and processing capability.

Faces 36 and 38 on hammers 32 preferably are formed of a durable alloy of steel. Adding to overall durability of the unit, a removable wear plate 72 desirably is secured in a position to shield the housing wall portion and the intake side of screen 16 where the impact forces create the greatest degree of wear. While the assembly is constructed to be rugged in performance, a typical model weighed only about one hundred fifty pounds. On the other hand, an extra heavy duty version may be fabricated for users that require continuous grinding of hard material.

When desired, a gasoline-fueled engine may be substituted for electric motor 20. In that case, a centrifugal clutch preferably is employed in the motive drive coupling.

In another alternative, adjustable-height legs are secured to depend downwardly from the ends of arms 60 and 62 opposite dolly 66. That results in a free-standing base for the hammermill. A bagging attachment then may be mounted on the underside of baseplate 50 to permit the packaging of processed material for sale, transportation or storage.

In typical use, a rotor speed of about 1000 rpm may be used for grog, 1700 rpm for clay and 2900 rpm for rock. While output quantity will vary greatly with variation in material, rate of feed, screen size, speed and operation skill, a very general approximation for the illustrated model is up to 2000 pounds per hour for a medium grind of dry clay down to between 100 and 400 pounds per hour for a fine grind of hard rock.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

It is claimed:

1. A hammermill which comprises:

an upright housing including an upper portion which defines a material-receiving chamber and a lower portion which defines a comminution chamber;

an apertured screen disposed in the bottom of said comminution chamber for permitting the gravity discharge of material comminuted within said lower portion;

a shaft mounted horizontally within said lower portion;

means for driving said shaft in rotation;

and a plurality of hammers projecting rigidly outward from said shaft, said hammers being arranged in an assembly which includes a succession of hammer-carrying elements integrally carrying respective ones of said hammers and individually spaced successively along said shaft, each of said elements having an integral plurality of said hammers circumferentially spaced successively around said shaft, and each of said hammers including a material-impacting leading face of concave-arcuate conformation in the plane of movement of said hammers with each of said leading faces merging into a reversely-directed concave trailing face of the next successive one of said hammers on the same side of said shaft and with each set of said merging leading and trailing faces defining a single large concavity.

2. A hammermill as defined in claim 1 in which said shaft is mounted within said lower portion in a manner permitting its end-for-end reversibility.

3. A hammermill as defined in claim 1 in which, within each of said elements, respective different ones of said hammers on a given one of said elements are displaced from one another in the direction of said shaft.

4. A hammermill as defined in claim 1 which further includes a baseplate upon which said housing is mounted, and a plurality of concentrically-spaced rings which project downwardly from said baseplate for selective mounting upon the upper rims of respectively differently sized containers.

5. A hammermill as defined in claim 1 which further includes:

a baseplate upon which said housing is mounted;

a dolly having horizontal arms projecting from respective uprights;

means for securing said baseplate to said arm;

means for adjusting the effective height of said arms;

means for adjusting the spacing of said housing from said uprights;

and in which said uprights slant downwardly and outwardly away from said baseplate.

6. A hammermill as defined in claim 1 which further includes a wear plate removably disposed over a portion of said screen beneath said material-receiving chamber and in a position to shield the portions of said screen and housing subject to maximum impact forces.

7. A hammermill which comprises:

an upright housing including an upper portion which defines a material-receiving chamber and a lower portion which defines a comminution chamber;

an apertured screen disposed in the bottom of said comminution chamber for permitting the gravity discharge of material comminuted within said lower portion;

a shaft mounted horizontally within said lower portion;

means for driving said shaft in rotation;

a plurality of hammers projecting rigidly outward from said shaft, said hammers being arranged in an assembly which includes a succession of hammer-carrying elements integrally carrying respective ones of said hammers and individually spaced successively along said shaft, each of said elements having an integral total number of three of said hammers circumferentially equally spaced successively around shaft, and each of said hammers including a material-impacting face of concave-arcuate conformation in the plane of movement of said hammers;

and each of said faces merging into a reversely-directed concave face of the next successive one of said hammers on the same side of said shaft, the area of merger of said faces and said reversely-directed concave faces defining a comminution area and the distribution of said hammers and said elements around said shaft defining equilateral symmetry.

8. A hammermill as defined in claim 7 in which successive different ones of said hammers on any given one of said elements are displaced one from the next in the direction of said shaft.

9. A hammermill as defined in claim 7 which further includes:

a base plate upon which said housing is mounted;

and a plurality of concentrically-spaced rings projecting downwardly from said base plate for selective mounting upon upper rims of respectively different sized containers.

* * * * *